US010484804B2

(12) United States Patent
Solum et al.

(10) Patent No.: US 10,484,804 B2
(45) **Date of Patent: *Nov. 19, 2019**

(54) HEARING ASSISTANCE DEVICE EAR-TO-EAR COMMUNICATION USING AN INTERMEDIATE DEVICE

(71) Applicant: Starkey Laboratories, Inc., Eden Prairie, MN (US)

(72) Inventors: Jeffrey Paul Solum, Greenwood, MN (US); Stephen Paul Flood, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/714,626

(22) Filed: Sep. 25, 2017

(65) Prior Publication Data

US 2018/0014131 A1 Jan. 11, 2018

Related U.S. Application Data

(63) Continuation of application No. 15/019,895, filed on Feb. 9, 2016, now Pat. No. 9,774,961.

(Continued)

(51) Int. Cl.
*H04R 25/00* (2006.01)

(52) U.S. Cl.
CPC ..... *H04R 25/554* (2013.01); *H04R 25/305* (2013.01); *H04R 25/552* (2013.01); *H04R 25/558* (2013.01); *H04R 2225/55* (2013.01)

(58) Field of Classification Search
CPC . H04R 25/554; H04R 25/558; H04R 2225/55
See application file for complete search history.

(56) References Cited

U.S. PATENT DOCUMENTS 5,479,522 A 12/1995 Lindemann et al.
5,734,976 A 3/1998 Bartschi et al.

(Continued)

FOREIGN PATENT DOCUMENTS

CN 1191060 A 8/1998
CN 101175342 5/2008

(Continued)

OTHER PUBLICATIONS

"U.S. Appl. No. 11/447,617, Final Office Action dated Mar. 3, 2010", 31 pgs.

(Continued)

*Primary Examiner* — Tuan D Nguyen
(74) *Attorney, Agent, or Firm* — Schwegman Lundberg & Woessner, P.A.

(57) ABSTRACT

Disclosed herein, among other things, are systems and methods for relaying wireless communication from ear-to-ear for hearing assistance devices using an intermediate device. One aspect of the present subject matter includes a method of using a first hearing assistance device in a first ear of a wearer to communicate with a second hearing assistance device in a second ear of the wearer using wireless communication, and determining whether quality of the communication between the devices has fallen below a programmable threshold such that communication can be improved by relaying the communication using an external intermediary device such as a smart phone. One method of determining the quality is to monitor a number of retransmissions that are used to maintain communication between the left and right devices.

20 Claims, 1 Drawing Sheet

Related U.S. Application Data

(60) Provisional application No. 62/113,672, filed on Feb. 9, 2015.

(56) References Cited

U.S. PATENT DOCUMENTS

| | | | |
|---|---|---|---|
| 5,757,932 | A | 5/1998 | Lindemann et al. |
| 5,966,639 | A | 10/1999 | Goldberg et al. |
| 6,088,339 | A | 7/2000 | Meyer |
| 6,633,645 | B2 | 10/2003 | Bren et al. |
| 6,694,034 | B2 | 2/2004 | Julstrom et al. |
| 6,760,457 | B1 | 7/2004 | Bren et al. |
| 7,062,223 | B2 | 6/2006 | Gerber et al. |
| 7,412,294 | B1 | 8/2008 | Woolfork |
| 7,519,194 | B2 | 4/2009 | Niederdrank et al. |
| 7,778,432 | B2 | 8/2010 | Larsen |
| 8,041,062 | B2 | 10/2011 | Cohen et al. |
| 8,041,066 | B2 | 10/2011 | Solum |
| 8,169,938 | B2 | 5/2012 | Duchscher et al. |
| 8,194,901 | B2 | 6/2012 | Alber et al. |
| 8,515,114 | B2 | 8/2013 | Solum |
| 8,548,180 | B2 | 10/2013 | Takagi et al. |
| 8,588,443 | B2 | 11/2013 | Glatt et al. |
| 9,282,416 | B2 | 3/2016 | Solum |
| 9,774,961 | B2 | 9/2017 | Solum et al. |
| 9,854,369 | B2 | 12/2017 | Solum |
| 2002/0030871 | A1 | 3/2002 | Anderson et al. |
| 2003/0059073 | A1 | 3/2003 | Bren et al. |
| 2003/0083058 | A1 | 5/2003 | Mayer |
| 2003/0215106 | A1 | 11/2003 | Hagen et al. |
| 2004/0037442 | A1 | 2/2004 | Nielsen et al. |
| 2004/0052391 | A1 | 3/2004 | Bren et al. |
| 2004/0259585 | A1 | 12/2004 | Yitzchak et al. |
| 2005/0100182 | A1 | 5/2005 | Sykes et al. |
| 2005/0111682 | A1 | 5/2005 | Essabar et al. |
| 2005/0160270 | A1 | 7/2005 | Goldberg et al. |
| 2005/0197061 | A1 | 9/2005 | Hundal |
| 2005/0283263 | A1 | 12/2005 | Eaton et al. |
| 2006/0067549 | A1 | 3/2006 | Puder et al. |
| 2006/0067550 | A1 | 3/2006 | Puder et al. |
| 2006/0093172 | A1 | 5/2006 | Ludvigsen et al. |
| 2006/0205349 | A1 | 9/2006 | Passier et al. |
| 2006/0274747 | A1 | 12/2006 | Duchscher et al. |
| 2007/0149261 | A1 | 6/2007 | Huddart |
| 2008/0159548 | A1 | 7/2008 | Solum |
| 2011/0090837 | A1 | 4/2011 | Duchscher et al. |
| 2011/0150255 | A1 | 6/2011 | Solum |
| 2012/0121094 | A1 | 5/2012 | Solum |
| 2013/0004002 | A1 | 1/2013 | Duchscher et al. |
| 2014/0177885 | A1 | 6/2014 | Solum |
| 2016/0044426 | A1 | 2/2016 | Duchscher et al. |
| 2016/0234612 | A1 | 8/2016 | Solum et al. |
| 2016/0323677 | A1 | 11/2016 | Solum |
| 2017/0238103 | A1* | 8/2017 | Gehring ..... H04R 25/552 381/23.1 |
| 2018/0206048 | A1 | 7/2018 | Solum |

FOREIGN PATENT DOCUMENTS

| | | | |
|---|---|---|---|
| CN | 102687533 | | 9/2012 |
| CN | 101233786 | B | 5/2013 |
| CN | 107534819 | A | 1/2018 |
| EP | 1185138 | A2 | 3/2002 |
| EP | 1445982 | A1 | 8/2004 |
| EP | 1519625 | A2 | 3/2005 |
| EP | 1531650 | A2 | 5/2005 |
| EP | 1643801 | A2 | 4/2006 |
| EP | 1670283 | A1 | 6/2006 |
| EP | 1715718 | A2 | 10/2006 |
| EP | 2613566 | A1 | 7/2013 |
| EP | 2582158 | B1 | 8/2016 |
| KR | 101253799 | B1 | 4/2013 |
| WO | WO-9641498 | A1 | 12/1996 |
| WO | WO-0167433 | A1 | 9/2001 |
| WO | WO-0209363 | A2 | 1/2002 |
| WO | WO-2002009363 | A2 | 1/2002 |
| WO | WO-04034738 | A1 | 4/2004 |
| WO | WO-2004100607 | A1 | 11/2004 |
| WO | WO-2004110099 | A2 | 12/2004 |
| WO | WO-2005101731 | A2 | 10/2005 |
| WO | WO-2006074655 | A1 | 7/2006 |
| WO | WO-2006133158 | A1 | 12/2006 |
| WO | WO-2008151624 | A1 | 12/2008 |
| WO | WO-2014184394 | A2 | 11/2014 |
| WO | WO-2014198323 | A1 | 12/2014 |
| WO | WO-2016130593 | A1 | 8/2016 |

OTHER PUBLICATIONS

"U.S. Appl. No. 11/447,617, Non Final Office Action dated Aug. 31, 2011", 29 pgs.
"U.S. Appl. No. 11/447,617, Non-Final Office Action dated Jun. 22, 2009", 25 pgs.
"U.S. Appl. No. 11/447,617, Notice of Allowance dated Mar. 16, 2012", 8 pgs.
"U.S. Appl. No. 11/447,617, Response filed Feb. 29, 2012 to Non Final Office Action dated Aug. 31, 2011", 13 pgs.
"U.S. Appl. No. 11/447,617, Response filed May 26, 2009 to Restriction Requirement dated Apr. 24, 2009", 8 pgs.
"U.S. Appl. No. 11/447,617, Response filed Aug. 3, 2010 to Final Office Action dated Mar. 3, 2010", 14 pgs.
"U.S. Appl. No. 11/447,617, Response filed Nov. 23, 2009 to Non Final Office Action dated Jun. 22, 2009", 15 pgs.
"U.S. Appl. No. 11/447,617, Restriction Requirement dated Apr. 24, 2009", 6 pgs.
"U.S. Appl. No. 11/619,541, Non Final Office Action dated Dec. 21, 2010", 7 pgs.
"U.S. Appl. No. 11/619,541, Notice of Allowance dated Jul. 5, 2011", 6 pgs.
"U.S. Appl. No. 11/619,541, Response filed May 23, 2011 to Non Final Office Action dated Dec. 21, 2010", 10 pgs.
"U.S. Appl. No. 12/980,696, Non Final Office Action dated Apr. 20, 2011", 7 pgs.
"U.S. Appl. No. 13/270,860, Non Final Office Action dated Dec. 18, 2012", 5 pgs.
"U.S. Appl. No. 13/270,860, Notice of Allowance dated Apr. 17, 2013", 10 pgs.
"U.S. Appl. No. 13/270,860, Preliminary Amendment filed Jan. 27, 2012", 7 pgs.
"U.S. Appl. No. 13/270,860, Response filed Mar. 18, 2013 to Non Final Office Action dated Dec. 18, 2012", 7 pgs.
"U.S. Appl. No. 13/458,304, Non Final Office Action dated Mar. 3, 2015", 9 pgs.
"U.S. Appl. No. 13/458,304, Response filed Jul. 6, 2015 to Non Final Office Action dated Mar. 3, 2015", 7 pgs.
"U.S. Appl. No. 13/970,368, Non Final Office Action dated Jun. 17, 2015", 6 pgs.
"U.S. Appl. No. 13/970,368, Notice of Allowance dated Oct. 29, 2015", 9 pgs.
"U.S. Appl. No. 13/970,368, Preliminary Amendment dated Mar. 6, 2014", (Mar. 6, 2014), 6 pgs.
"U.S. Appl. No. 13/970,368, Response filed Sep. 16, 2015 to Non Final Office Action dated Jul. 17, 2015", 15 pgs.
"U.S. Appl. No. 14/920,446, Advisory Action dated Aug. 15, 2017", 2 pgs.
"U.S. Appl. No. 14/920,446, Final Office Action dated May 4, 2017", 9 pgs.
"U.S. Appl. No. 14/920,446, Non Final Office Action dated Sep. 22, 2016", 8 pgs.
"U.S. Appl. No. 14/920,446, Respons filed Aug. 4, 2017 to Final Office Action dated May 4, 2017", 9 pgs.
"U.S. Appl. No. 14/920,446, Response filed Dec. 21, 2016 to Non Final Office Action dated Sep. 22, 2016", 8 pgs.
"U.S. Appl. No. 15/019,895, Non Final Office Action dated Dec. 29, 2016", 10 pgs.
"U.S. Appl. No. 15/019,895, Notice of Allowance dated May 25, 2017", 13 pgs.

(56) References Cited

OTHER PUBLICATIONS

"U.S. Appl. No. 15/019,895, Notice of Allowance dated May 25, 2017", 12 pgs.
"U.S. Appl. No. 15/019,895, Response filed Mar. 29, 2017 to Non Final Office Action dated Dec. 29, 2017", 7 pgs.
"U.S. Appl. No. 15/061,309, Final Office Action dated May 2, 2017", 7 pgs.
"U.S. Appl. No. 15/061,309, Non Final Office Action dated Nov. 28, 2016", 7 pgs.
"U.S. Appl. No. 15/061,309, Notice of Allowability dated Sep. 6, 2017", 2 pgs.
"U.S. Appl. No. 15/061,309, Notice of Allowability dated Sep. 12, 2017", 2 pgs.
"U.S. Appl. No. 15/061,309, Notice of Allowance dated Sep. 25, 2017", 14 pgs.
"U.S. Appl. No. 15/061,309, Preliminary Amendment filed Oct. 27, 2016", 6 pgs.
"U.S. Appl. No. 15/061,309, Response filed Aug. 1, 2017 to Final Office Action dated May 2, 2017", 6 pgs.
"U.S. Appl. No. 15/061,309, Response flied Feb. 28, 2017 to Non Final Office Action dated Nov. 28, 2016", 7 pgs.
"U.S. Appl. No. 15/019,895, Examiner Interview Summary dated May 25, 2017", 1 pg.
"U.S. Appl. No. 15/061,309, Notice of Allowance dated Aug. 25, 2017", 14 pgs.
"Chinese Application Serial No. 2,609,979, Response filed Aug. 16, 2011 to Office Action dated Apr. 12, 2011", w/English claims, 15 pgs.
"Chinese Application Serial No. 200680028085.8, Office Action dated Apr. 12, 2011", w/English translation, 3 pgs.
"Chinese Application Serial No. 200680028085.8, Office Action dated Sep. 30, 2011", w/English translation, 8 pgs.
"Chinese Application Serial No. 200680028085.8, Office Action dated Jun. 29, 2012", w/English translation, 8 pgs.
"Chinese Application Serial No. 200680028085.8, Response filed Apr. 13, 2012 to Office Action dated Sep. 30, 2011", w/English claims, 15 pgs.
"Chinese Application Serial No. 200680028085.8, Response filed Nov. 14, 2012 to Office Action dated Jun. 29, 2012", w/English claims, 14 pgs.
"European Application Serial No. 06772250.4, Office Action dated Oct. 18, 2012", 5 pgs.
"European Application Serial No. 06772250.4, Communication Pursuant to Article 94(3) EPC dated Sep. 17, 2015", 5 pgs.
"European Application Serial No. 06772250.4, Office Action dated Dec. 22, 2010", 3 pgs.
"European Application Serial No. 06772250.4, Response filed Apr. 25, 2013 to Office Action dated Oct. 18, 2012", 7 pgs.
"European Application Serial No. 06772250.4, Response filed Jun. 24, 2011 to Office Action dated Dec. 22, 2010", 18 pgs.
"European Application Serial No. 07254947.0, Extended European Search Report dated Apr. 3, 2008", 6 pgs.
"European Application Serial No. 07254947.0, Office Action dated Aug. 25, 2008", 1 pgs.
"European Application Serial No. 07254947.0, Office Action dated Jan. 19, 2012", 5 pgs.
"European Application Serial No. 07254947.0, Office Action dated Oct. 12, 2010", 4 pgs.
"European Application Serial No. 07254947.0, Response filed Apr. 26, 2011 to Official Communication dated Oct. 12, 2010", 11 pgs.
"European Application Serial No. 07254947.0, Response filed Jul. 20, 2012 to Examination Notification Art. 94(3) dated Jan. 19, 2012", 9 pgs.
"European Application Serial No. 07254947.0, Response filed Feb. 28, 2009 to Official Communication dated Aug. 25, 2008", 2 pgs.
"European Application Serial No. 07254947.0, Summons to Attend Oral Proceedings mailed Nov. 7, 2014", 3 pgs.
"European Application Serial No. 13150071.2, Extended European Search Report dated Feb. 15, 2013", 7 pgs.
"European Application Serial No. 13150071.2, Response filed Oct. 17, 2013 to Extended European Search Report dated Feb. 15, 2013", 23 pgs.
"International Application Serial No. PCT/US2006/021870, International Preliminary Report on Patentability dated Dec. 6, 2007", 8 pgs.
"International Application Serial No. PCT/US2006/021870, International Search Report and Written Opinion dated Nov. 3, 2006", 13 pgs.
"International Application Serial No. PCT/US2016/017214, International Preliminary Report on Patentability dated Aug. 24, 2017", 9 pgs.
"International Application Serial No. PCT/US2016/017214, International Search Report dated Jun. 10, 2016", 4 pgs.
"International Application Serial No. PCT/US2016/017214, Written Opinion dated Jun. 10, 2016", 7 pgs.
"Korean Application Serial No. 10-2008-7000332, Office Action dated Aug. 15, 2012", w/English translation, 9 pgs.
"Korean Application Serial No. 10-2008-7000332, Response filed Oct. 15, 2012 to Office Action dated Aug. 15, 2012", w/English claims, 22 pgs.
"Korean Application Serial No. 10-2008-7000332, Voluntary Amendment filed Jun. 9, 2011", w/ English Translation, 14 pgs.
Liu, Tao, et al., "Performance Evaluation of Link Quality Estimation Metrics for Static Multihop Wireless Sensor Networks", Mesh and Ad Hoc Communications and Networks SECON '09. 6th Annual IEEE Communications Society Conference on, IEEE, Piscataway, (Jun. 22, 2009), 1-9.
"U.S. Appl. No. 15/851,953, Preliminary Amendment filed Apr. 9, 2018", 7 pgs.
"U.S. Appl. No. 15/851,953, Supplemental Preliminary Amendment", 6 pgs.
"European Application Serial No. 16709170.1, Response filed Apr. 3, 2018 to Office Action dated Sep. 20, 2017", 42 pgs.
"U.S. Appl. No. 15/851,953, Non Final Office Action dated Mar. 29, 2019", 14 pgs.
"U.S. Appl. No. 15/851,953, Response filed Jun. 27, 2019 to Non-Final Office Action dated Mar. 29, 2019", 7 pgs.
"Chinese Application Serial No. 201680009281.4, Office Action dated Jun. 20, 2019", W English Translation, 16 pgs.

* cited by examiner

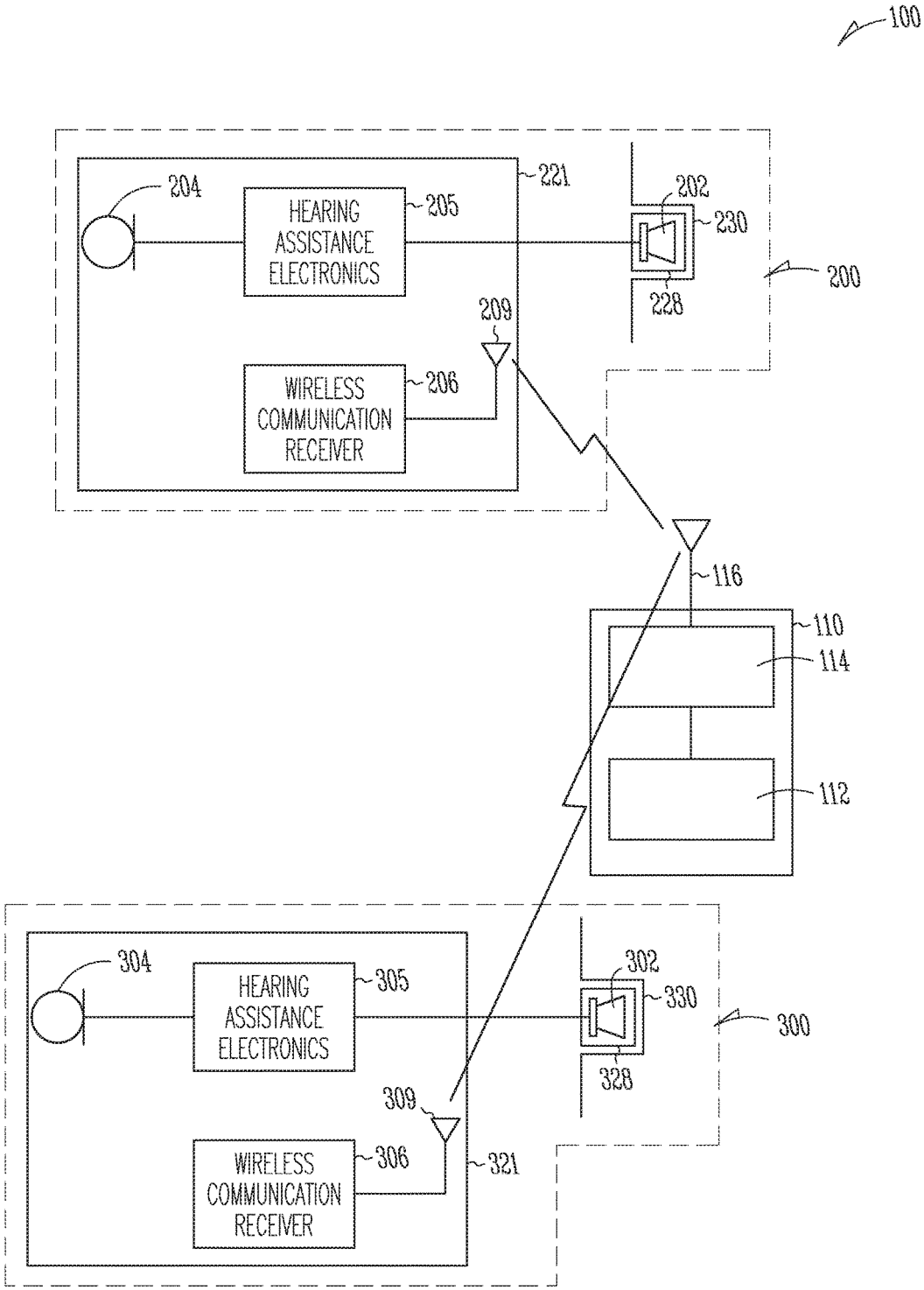
100
204
HEARING ASSISTANCE ELECTRONICS
205
221
202
230
200
228
209
WIRELESS COMMUNICATION RECEIVER
206
116
110
114
112
304
HEARING ASSISTANCE ELECTRONICS
305
302
330
300
328
309
WIRELESS COMMUNICATION RECEIVER
306
321

HEARING ASSISTANCE DEVICE EAR-TO-EAR COMMUNICATION USING AN INTERMEDIATE DEVICE

CROSS REFERENCE TO RELATED APPLICATIONS

This application is a continuation of U.S. patent application Ser. No. 15/019,895, filed Feb. 9, 2016, now issued as U.S. Pat. No. 9,774,961, which claims the benefit of priority under 35 U.S.C. § 119(e) of U.S. Provisional Application Ser. No. 62/113,672 filed Feb. 9, 2015, all of which are hereby incorporated by reference herein in their entirety. This application is related to co-pending, commonly assigned, U.S. patent application Ser. No. 13/970,368, entitled "WIRELESS SYSTEM FOR HEARING COMMUNICATION DEVICES PROVIDING WIRELESS STEREO RECEPTION MODES", filed on Aug. 19, 2013, which is a continuation of U.S. patent application Ser. No. 13/270,860, filed Oct. 11, 2011 (issued as U.S. Pat. No. 8,515,114 on Aug. 20, 2013) which is a continuation of U.S. patent application Ser. No. 11/619,541, filed Jan. 3, 2007 (issued as U.S. Pat. No. 8,041,066 on Oct. 18, 2011), all of which are hereby incorporated by reference herein in their entirety. This application is also related to co-pending, commonly assigned, U.S. patent application Ser. No. 13/458,304, entitled "COMMUNICATION SYSTEM FOR WIRELESS AUDIO DEVICES", filed on Apr. 27, 2012, which is a continuation of U.S. patent application Ser. No. 11/447,617, filed on Jun. 5, 2006 (issued as U.S. Pat. No. 8,169,938 on May 1, 2012), which claims the benefit of priority under 35 U.S.C. § 119(e) of U.S. Provisional Application Ser. No. 60/687,707 filed Jun. 5, 2005, all of which are hereby incorporated by reference herein in their entirety.

TECHNICAL FIELD

This document relates generally to wireless communication systems and more particularly to a hearing assistance device ear-to-ear communication using an intermediate device.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Hearing assistance devices often need to be accessed remotely for fitting and programming of the devices. Data such as configuration parameters and telemetry information can be downloaded and/or uploaded to the hearing assistance devices for the purpose of programming, control and data logging. Additional wireless communication functions such as remote control and streaming audio can be integrated. In addition, ear-to-ear communication between hearing assistance devices may be used to transfer information. However, the direct communication path between ears of a wearer can be impaired due to relatively high attenuation.

Accordingly, there is a need in the art for improved systems and methods for ear-to-ear communication.

SUMMARY

Disclosed herein, among other things, are systems and methods for relaying wireless communication from ear-to-ear for hearing assistance devices using an intermediate device. One aspect of the present subject matter includes a method of using an external wireless communication device. One embodiment of the method includes eavesdropping on communication between a left hearing assistance device and a right hearing assistance device worn by a wearer, and determining whether communication between the left device and the right device has fallen below a programmable threshold. If communication between the left device and the right device has fallen below the programmable threshold, the external wireless communication device is used to relay communication between the two devices, in various embodiments. In another embodiment, the hearing devices themselves can determine when communication has fallen to unacceptable levels and request an intermediate device to perform a relay operation between the hearing devices.

One aspect of the present subject matter includes a method of using a first hearing assistance device in a first ear of a wearer to communicate with a second hearing assistance device in a second ear of the wearer using wireless communication, and determining whether quality of the communication between the devices has fallen below a programmable threshold such that communication can be improved by relaying the communication using an external intermediary device such as a smart phone. One method of determining the quality is to monitor a number of retransmissions that are used to maintain communication between the left and right devices.

One aspect of the present subject matter includes a system for wireless communication, including a first hearing assistance device configured to be worn in a first ear of a wearer and a second hearing assistance device configured to be worn in a second ear of a wearer. A processor is programmed to determine whether communication between the first device and the second device has fallen below a programmable threshold and, if communication between the first device and the second device has fallen below the programmable threshold, use an external wireless communication device to relay communication between the first and second devices.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 1 illustrates a block diagram of a system including hearing assistance devices adapted to be worn by a wearer and an external wireless communication device, according to various embodiments of the present subject matter.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Ear-to-ear communication between hearing assistance devices may be used to transfer information. However, the direct communication path between ears of a wearer can include relatively high attenuation. This may be due to multi-path interference, absorption of signal energy due to the presence of the human body, or outside interference that may be blocking the receiver, etc. Accordingly, there is a need in the art for improved systems and methods for ear-to-ear communication.

Disclosed herein, among other things, are systems and methods for relaying wireless communication from ear-to-ear for hearing assistance devices using an intermediate device. One aspect of the present subject matter includes a method of using an external wireless communication device. One embodiment of the method includes eavesdropping on communication between a left hearing assistance device and a right hearing assistance device worn by a wearer, and determining whether communication between the left device and the right device has fallen below a programmable threshold. If communication between the left device and the right device has fallen below the programmable threshold, the external wireless communication device is used to relay communication between the two devices, in various embodiments. In another embodiment, the left and right hearing assistance devices can monitor the condition of the link between themselves and may when appropriate, based on the quality of the link, use a third device (such as the external wireless communication device) that each hearing assistance device is also communicating with to relay information between the left and right hearing assistance devices. The quality of the link can be measured by the packet error rate, the bit error rate, the number of retransmissions, the overall latency, and the receive signal strength of the received signal among other things, and a threshold can be used for one or more of these parameters in various embodiments.

Various embodiments include a method of using an external wireless communication device to relay communication between two hearing devices worn by a user when communication between the left and right hearing devices has fallen below a threshold of quality, where communication can be significantly improved by relaying the communication through an external communication device, or external intermediary device, such as a smart phone. One such method of determining the quality is to monitor the number of retransmissions that are used to maintain communication between the left and right devices. Other parameters can be used for determining the quality, such as using a programmable threshold based on one or more of link margin, power capacity, latency, interference, number of retransmissions, and high path loss. In one embodiment, the external wireless communications device monitors the communication and makes the decision regarding relaying the communication. In another embodiment, one or both of the hearing assistance devices makes the decision regarding relaying the communication. In other embodiments, both the external wireless communications device and one or both hearing assistance devices make the decision, or contribute to the decision, as to whether to relay communication. In various embodiments, the present subject matter provides for switching dynamically between direct communication and relay communication to improve link quality, latency and power consumption.

In various embodiments, left and right 2.4 GHz hearing assistance devices relay a variety of control, initialization and synchronization commands as well as audio data from left to right and right to left hearing assistance devices. Rather than overcome the high attenuation of the direct ear-to-ear path, the present subject matter provides for one hearing assistance device to transmit its control, initialization, and synchronization commands or audio data to an intermediate device (such as an iPhone/iOS device), and the intermediate device then retransmits the information to the second hearing assistance device. In various embodiments, this is initiated by firmware in the hearing assistance devices and associated applications.

In various embodiments, ear-to-ear communication can involve transferring information such as control of the hearing instrument such as:

1. Volume control
2. Program or memory selection
3. Microphone selection (omni or directional)
4. Exchange of environmental information for the purpose of selecting an appropriate setting for signal processing of incoming audio.

Other types of information can be transferred, in various embodiments. User selected controls can be transferred so that the patient (or wearer) can, as an example, make volume changes by touching a button or proximity sensor on one hearing assistance device which then can be transferred wirelessly to the hearing assistance device in the other ear. One hearing assistance device, by way of example, can have a memory or program selection button that can be selected and the program selection can be transferred to the other hearing assistance device by wireless transport. Other types of information can include audio data transferred between the devices for the purpose of binaural signal processing.

In various embodiments, the left and right hearing assistance devices can have sufficient link margin and power capacity to connect to each other directly, or they may not have such margin and capacity, in which case they can rely on a relay mechanism such as a smart phone or remote control that is wirelessly connected to each hearing assistance device. The margin and capacity can be set as programmable thresholds, and other parameters can be used as one or more thresholds, such as latency, interference, number of retransmissions, and high path loss, in various embodiments. Thus, when one hearing assistance device wants to transmit or receive information from the other hearing assistance device it can do so using a relay device that wirelessly relays information received from one hearing assistance device and then transmits that information to the other hearing assistance device. The hearing assistance devices may choose to communicate directly or through a third party relay device, and this decision can be dynamic to improve the connection between devices in various embodiments. In various embodiments, improving the connection between left and right devices improves latency and lowers power consumption, since fewer data retransmissions and less forward error correction overhead is need to facilitate communications.

Various situations arise where direct wireless communication between two hearing instruments worn on the head is difficult or impossible. For example:

1. The frequency used is not conducive to direct communication such as the case for 2.4 GHz operation where significant absorption by the human body of the radio frequency (RF) energy prevents successful communication;

2. Multipath fading (or lack thereof) has rendered communication difficult of impossible;

3. Interference from various sources has rendered communication impossible; or

4. The hearing assistance device antenna is too small (since it has to fit inside a person's ear) for reliable communication.

Under these conditions, the present subject matter provides for the use of an auxiliary (or intermediate) device such as a smartphone or remote control that is capable of communication with the hearing assistance devices to relay information between the two.

Modern hearing assistance devices are equipped with wireless radios capable of handling standard protocols such as Bluetooth or These well-known standards are built into many consumer based products such as mobile phones, tablets, computers, TV's, music players, etc. All of these devices can be used in conjunction with modern hearing instruments such that they can communicated directly or indirectly with them using these standard based protocols. In various embodiments, one or more of these devices can be used to relay information between the left and right hearing assistance devices at any layer within the protocol stack. The layers may include, but are not limited to, the physical layer, the data link layer, the network layer, the transport layer, the presentation layer, or the application layer.

In various embodiments, the hearing assistance devices communicate with one another un-aided by another device if the conditions warrant, and yet rely on an auxiliary device to relay the information if the condition are preventing reliable direct communication. Both methods can exist in parallel or the hearing assistance devices may switch between one method or the other to communicate with one another, in various embodiments. In various embodiments, the remote device may be capable of eavesdropping on the two hearing assistance devices in their direct communication and make the decision on relaying based on their success or failure to communicate with one another, such as by using a programmable threshold. The communications between the hearing assistance devices and wireless device may include communications as set forth in U.S. patent application Ser. No. 13/970,368, which was incorporated by reference. Other communications and devices may be employed without departing from the scope of the present subject matter.

FIG. 1 illustrates a block diagram of a system 100, according to the present subject matter. The illustrated system 100 shows an external wireless communication device 110 in wireless communication with a left hearing assistance device 200 and a right hearing assistance device 300. In various embodiments, the left hearing assistance device 200 includes a first housing 221, an acoustic receiver or speaker 202, positioned in or about the left ear canal 230 of a wearer and conductors 223 coupling the receiver 202 to the first housing 221 and the electronics enclosed therein. The electronics enclosed in the first housing 221 includes a microphone 204, hearing assistance electronics 205, a wireless communication transceiver 206 and an antenna 207. In various embodiments, the hearing assistance electronics 205 includes at least one processor and memory components. The memory components store program instructions for the at least one processor. In various embodiments, the memory components also store data logged by the hearing assistance device. The program instructions include functions allowing the processor and other components to process audio received by the microphone 204 and transmit processed audio signals to the speaker 202. The speaker emits the processed audio signal as sound in the user's left ear canal. In various embodiments, the hearing assistance electronics includes functionality to amplify, filter, limit, condition or a combination thereof, the sounds received using the microphone 204.

In various embodiments, the right hearing assistance device 300 includes a first housing 321, an acoustic receiver or speaker 302, positioned in or about the ear canal 330 of a wearer and conductors 323 coupling the receiver 302 to the first housing 321 and the electronics enclosed therein. The electronics enclosed in the first housing 321 includes a microphone 304, hearing assistance electronics 305, a wireless communication transceiver 306 and an antenna 307. In various embodiments, the hearing assistance electronics 305 includes at least one processor and memory components. The memory components store program instructions for the at least one processor. In various embodiments, the memory components also store data logged by the hearing assistance device. The program instructions include functions allowing the processor and other components to process audio received by the microphone 304 and transmit processed audio signals to the speaker 302. The speaker emits the processed audio signal as sound in the user's ear canal. In various embodiments, the hearing assistance electronics includes functionality to amplify, filter, limit, condition or a combination thereof, the sounds received using the microphone 304.

The external device 110 includes an antenna 116 connected to processing electronics 114 that include a transceiver, in an embodiment. In various embodiments, the external device 110 includes one or more components 112 connected to the processing electronics 114, such as memory components, sensing components or other types of electrical components. In various embodiments, the external device 110 includes a smart phone, such as an iPhone/iOS device. The external device can include one or more of a tablet, computer, television, or music player, in various embodiments. According to various embodiments, the external device 110 is configured to relay wireless communication between the left device 200 and the right device 300.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In other embodiments, audio can be processed using inputs from microphones in each hearing device that can be sent wirelessly between devices using a means of communication known as binaural processing. Such communication can be realized as direct communication between devices or, as this subject matter points out, a combination of direct communication and via an external relay. In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter. The communications between the hearing assistance devices and wireless device may include communications as set forth in U.S. patent application Ser. No. 13/458,304, which was incorporated by reference. Other communications and devices may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface, in various embodiments, such connections include all past and present link protocols. It is also contemplated that future versions of these protocols and new protocols may be employed without departing from the scope of the present subject matter.

In various embodiments, the present subject matter is used in hearing assistance devices that are configured to communicate with mobile phones. In such embodiments, the hearing assistance device may be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices, bone conduction devices, and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A system for wireless communication, comprising:

a first audio device configured to be worn in a first ear of a wearer;

a second audio device configured to be worn in a second ear of the wearer; and an external device in wireless communication with at least one of the first device and the second device, the external device including:

a wireless communication transceiver; and a processor in communication with the wireless transceiver, the processor configured to:

monitor communication between the first device and the second device;

determine whether communication between the first device and the second device has fallen below a programmable threshold, wherein the programmable threshold includes a link margin threshold; and if communication between the first device and the second device has fallen below the programmable threshold, using the wireless communication transceiver to switch dynamically between direct communication and relay communication between the first and second devices, to improve link quality, latency and power consumption.

2. The system of claim 1, wherein the processor is configured to monitor a number of retransmissions used to communicate between the first and second devices to determine whether communication between the first device and the second device has fallen below a programmable threshold.

3. The system of claim 1, wherein the processor is configured to monitor a receive signal strength between the first and second devices to determine whether communication between the first device and the second device has fallen below a programmable threshold.

4. The system of claim 1, wherein the processor is configured to monitor a number of retransmissions between the first and second devices to determine whether communication between the first device and the second device has fallen below a programmable threshold.

5. The system of claim 1, wherein the wireless communication transceiver is configured to use 2.4 GHz communication to relay communication between the first and second devices.

6. The system of claim 1, wherein the external device includes a smart phone.

7. The system of claim 1, wherein the external device includes a remote control.

8. The system of claim 1, wherein the external device includes a tablet.

9. The system of claim 1, wherein the external device includes a personal computer.

10. The system of claim 1, wherein at least one of the first device and the second device includes a hearing aid.

11. A device, comprising:

a wireless communication transceiver; and a processor in communication with the wireless transceiver, the processor configured to:

monitor communication between a left audio device and a right audio device worn by a wearer;

determine whether communication between the left device and the right device has fallen below a programmable threshold, wherein the programmable threshold includes a link margin threshold; and if communication between the left device and the right device has fallen below the programmable threshold, using the wireless communication transceiver to switch dynamically between direct communication and relay communication between the first and second devices, to improve link quality, latency and power consumption.

12. The device of claim 11, wherein the processor is configured to measure link quality of communication between a left audio device and a right audio device.

13. The device of claim 12, wherein link quality is measured using a packet error rate.

14. The device of claim 12, wherein link quality is measured using a bit error rate.

15. The device of claim 12, wherein link quality is measured using a number of retransmissions.

16. The device of claim 12, wherein link quality is measured using overall latency of communication.

17. The device of claim 12, wherein link quality is measured using a receive signal strength.

18. The device of claim 11, wherein the processor is configured to eavesdrop on communication between the left audio device and the right audio device.

19. The device of claim 11, wherein the wireless communication transceiver is configured to use Bluetooth communication to relay communication between the first and second devices.

20. The device of claim 11, wherein the wireless communication transceiver is configured to use Wi-Fi communication to relay communication between the first and second devices.

* * * * *